US009964102B2

(12) United States Patent
Kondo et al.

(10) Patent No.: US 9,964,102 B2
(45) Date of Patent: May 8, 2018

(54) VARIABLE DISPLACEMENT COMPRESSOR WITH DRAIN PASSAGE

(71) Applicant: KABUSHIKI KAISHA TOYOTA JIDOSHOKKI, Aichi-ken (JP)

(72) Inventors: Hisaya Kondo, Kariya (JP); Hiroyuki Nakaima, Kariya (JP); Naoki Koeda, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 409 days.

(21) Appl. No.: 14/183,667

(22) Filed: Feb. 19, 2014

(65) Prior Publication Data

US 2014/0294632 A1 Oct. 2, 2014

(30) Foreign Application Priority Data

Mar. 29, 2013 (JP) ..... 2013-070751

(51) Int. Cl.
*F04B 53/04* (2006.01)
*F04B 27/08* (2006.01)
(Continued)

(52) U.S. Cl.
CPC ..... *F04B 27/0834* (2013.01); *F04B 27/109* (2013.01); *F04B 27/1045* (2013.01); *F04B 27/1804* (2013.01)

(58) Field of Classification Search
CPC ..... F04B 27/14; F04B 27/24; F04B 27/0834; F04B 27/1045; F04B 27/1804; F04B 27/109
(Continued)

(56) References Cited

U.S. PATENT DOCUMENTS 4,688,997 A 8/1987 Suzuki et al.
5,603,610 A 2/1997 Kawaguchi et al.
(Continued)

FOREIGN PATENT DOCUMENTS

CN 1157535 7/2004
CN 2929244 8/2007
(Continued)

OTHER PUBLICATIONS

Office Action issued in China Counterpart Patent Appl. No. 201410124189.5, dated Oct. 29, 2015.
(Continued)

*Primary Examiner* — Essama Omgba
*Assistant Examiner* — Stephen Mick
(74) *Attorney, Agent, or Firm* — Greenblum & Bernstein, P.L.C.

(57) ABSTRACT

A variable displacement compressor includes a swash plate, a housing and a displacement control valve. The housing has a crank chamber where the swash plate is disposed, a discharge chamber and a suction chamber. The housing has plural bolt holes and is formed by separate members fastened together by plural bolts inserted through the bolt holes. The displacement control valve has a first valve member movable to connect the crank chamber and the discharge chamber, controlling the position of the first valve member to vary compressor displacement. The displacement control valve has a valve chamber and a second valve member serving to connect the crank chamber and the suction chamber in the valve chamber. The valve chamber is connected to the crank chamber by a drain passage part of which serves as the bolt hole located at the lowest of the plural bolt holes when the compressor is installed.

2 Claims, 7 Drawing Sheets

(51) Int. Cl.
*F04B 27/10* (2006.01)
*F04B 27/18* (2006.01)

(58) Field of Classification Search
USPC ..... 417/222.1, 222.2, 272, 269; 137/87.06; 251/117; 62/228.3
See application file for complete search history.

(56) References Cited

U.S. PATENT DOCUMENTS

| | | | | |
|---|---|---|---|---|
| 5,607,286 | A * | 3/1997 | Takenaka | F04B 27/1036 417/222.2 |
| 6,149,398 | A * | 11/2000 | Fukanuma | F04B 27/0895 184/6.17 |
| 7,806,666 | B2 | 10/2010 | Umemura et al. | |
| 8,021,124 | B2 | 9/2011 | Umemura et al. | |
| 8,079,827 | B2 | 12/2011 | Iwa et al. | |
| 8,152,482 | B2 | 4/2012 | Umemura et al. | |
| 2002/0006337 | A1* | 1/2002 | Kimura | F04B 27/1804 417/222.2 |
| 2002/0006339 | A1* | 1/2002 | Ota | F04B 27/1081 417/222.2 |
| 2008/0078621 | A1* | 4/2008 | Imai | F04B 27/109 184/6.17 |
| 2010/0272583 | A1 | 10/2010 | Lee et al. | |
| 2013/0089445 | A1* | 4/2013 | Ishikawa | F04B 27/109 417/559 |
| 2014/0248163 | A1 | 9/2014 | Lee et al. | |

FOREIGN PATENT DOCUMENTS

| | | |
|---|---|---|
| DE | 3609058 | 10/1986 |
| DE | 19533340 | 3/1996 |
| JP | 08-261149 | 10/1996 |
| JP | 2008-014269 | 1/2008 |
| JP | 2009-103074 | 5/2009 |
| JP | 2009-297421 | 12/2009 |
| JP | 2010-031692 | 2/2010 |
| JP | 2012-132403 | 7/2012 |
| KR | 10-2010-0091794 | 8/2010 |
| WO | 2009/082176 | 7/2009 |
| WO | 2012/161514 | 11/2012 |

OTHER PUBLICATIONS

German Office Action in Patent Appl. No. 102014104329.4, dated Sep. 28, 2015, with English language translation.

* cited by examiner

VARIABLE DISPLACEMENT COMPRESSOR WITH DRAIN PASSAGE

BACKGROUND OF THE INVENTION

The present invention relates to a variable displacement compressor having a displacement control valve.

When a variable displacement compressor is at a stop for a long period of time, refrigerant present in the compressor is liquefied, and the liquid refrigerant is stored in a space such as a crank chamber and a suction chamber. In this case, the pressure in the crank chamber is high, so that the inclination of the swash plate disposed in the crank chamber is minimum. Since the pressure in the crank chamber is maintained at a high level at a start of the compressor and the inclination of the swash plate does not become maximum until no liquid refrigerant is present in the crank chamber, a desired cooling performance is not obtained quickly.

Such variable displacement compressor is provided with a bleed passage having therein a flow restrictor of a fixed cross-sectional area that serves to drain liquid refrigerant from the crank chamber into the suction chamber in order to control the displacement of the compressor while the compressor is operating. However, it takes a long time to drain the liquid refrigerant in the crank chamber through the bleed passage at a start of the compressor and, therefore, a desired cooling performance is not obtained quickly.

For example, Japanese Unexamined Patent Application Publication No. 2009-103074 discloses such variable displacement compressor having a displacement control valve that allows quick drain of liquid refrigerant from a control chamber (crank chamber) just after a start of the compressor thereby to shorten the time taken to increase the displacement. When the compressor is at a stop for a long period of time, liquid refrigerant is stored in the control chamber. When the liquid refrigerant stored in the control chamber flows into and fills a pressure-sensing chamber formed in the displacement control valve, a bellows disposed in the pressure-sensing chamber is contracted by the pressure of the liquid refrigerant against the urging force of a spring disposed in the bellows.

As a result, a pressure receiving member connected to the bellows is moved away from a second valve member of the displacement control valve. The liquid refrigerant present in the control chamber is flowed into a drain passage that is opened to the control chamber at a position adjacent to the central axis of the control chamber, and then the liquid refrigerant is drained into the suction chamber through the pressure-sensing chamber, an in-shaft passage, a gap passage, a recessed space and a valve chamber of the displacement control valve and a passage. Since refrigerant present in the discharge chamber is prevented from flowing into the control chamber, the pressure in the control chamber is quickly lowered and the inclination of the swash plate is quickly changed from minimum to maximum without being hampered by liquid refrigerant, so that a desired cooling performance is obtained quickly after a start of the compressor.

The structure disclosed in the above publication No. 2009-103074 does not necessarily shorten sufficiently the time taken to drain the liquid refrigerant in the control chamber. This is because the drain passage connecting the control chamber and the displacement control valve for draining of liquid refrigerant is located at a position adjacent to the central axis of the control chamber, or adjacent to the rotary shaft of the compressor. For example, when the compressor installed on a vehicle is started, the stored liquid refrigerant whose level is above the drain passage is quickly drained through the drain passage toward the suction chamber, but the stored liquid refrigerant whose level is between the drain passage and the bottom of the control chamber is not drained through the drain passage until the liquid refrigerant is evaporated. Thus, it takes a long time to drain the liquid refrigerant completely, and a desired cooling performance is not necessarily obtained quickly after a start of the compressor.

The present invention is directed to providing a variable displacement compressor of a structure that helps to shorten the time taken to drain liquid refrigerant in a crank chamber at a start of the compressor.

SUMMARY OF THE INVENTION

In accordance with an aspect of the present invention, a variable displacement compressor includes a swash plate the inclination of which is variable, a housing and a displacement control valve. The housing has therein a crank chamber in which the swash plate is disposed, a discharge chamber, a suction chamber and a cylinder bore. The housing has plural bolt holes and is formed by separate members that are fastened together by plural bolts inserted through the plural bolt holes. The displacement control valve has a first valve member movable to connect the crank chamber and the discharge chamber. The displacement control valve controls the position of the first valve member to vary the displacement of the compressor. The displacement control valve has a valve chamber and a second valve member that serves to connect the crank chamber and the suction chamber in the valve chamber. The valve chamber is connected to the crank chamber by a drain passage. Part of the drain passage serves as the bolt hole located at the lowest of the plural bolt holes when the compressor is installed.

Other aspects and advantages of the invention will become apparent from the following description, taken in conjunction with the accompanying drawings, illustrating by way of example the principles of the invention.

DETAILED DESCRIPTION OF THE EMBODIMENTS

Figure 1:
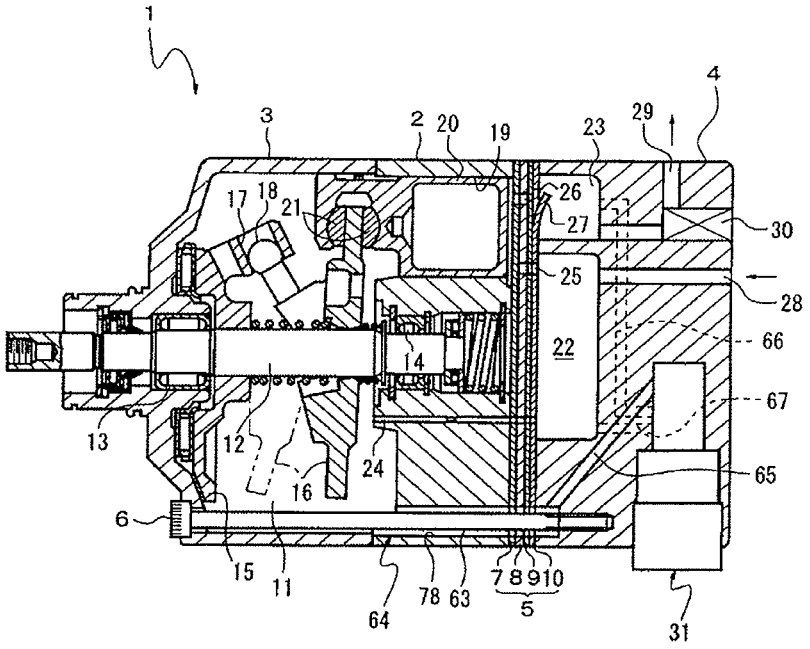
FIG. 1 is a longitudinal sectional view of a variable displacement compressor according to a first embodiment of the present invention.

The following will describe the first embodiment of the variable displacement compressor according to the present invention with reference to FIGS. 1 to 4. Referring to FIG. 1, the variable displacement compressor which is designated generally by 1 is of a clutchless type and intended for installation on a vehicle. It is noted that the left-hand side and the right-hand side of the compressor as viewed in FIG. 1 correspond to its front side and rear side, respectively, and that the upper and lower sides of the compressor as viewed in FIG. 1 correspond to its upper and lower sides, respectively. The compressor 1 has a housing that is formed by three separate members, namely, a cylinder block 2, a front housing 3 connected to the front end of the cylinder block 2 and a rear housing 4 connected to the rear end of the cylinder block 2 through a valve plate assembly 5. The front housing 3, the cylinder block 2, the valve plate assembly 5 and the rear housing 4 are fastened together by plural bolts 6 (only one shown in FIG. 1) inserted through plural round bolt holes 63 (also only one shown) formed in the housing of the compressor 1. The bolt hole 63 extends through the front housing 3, the cylinder block 2 and the valve plate assembly 5 to the rear housing 4.

The valve plate assembly 5 is composed of a suction-valve plate 7, a valve-port plate 8, a discharge-valve plate 9 and a retainer plate 10 which are laminated together in this order from the cylinder block 2. The bolts 6 are arranged circumferentially of the front housing 3 and inserted through the front housing 3, the cylinder block 2 and the valve plate assembly 5 and screwed into the rear housing 4.

The front housing 3 forms therein a crank chamber 11. The front housing 3 and the cylinder block 2 are equipped with radial bearings 13, 14, respectively, by which a rotary shaft 12 is rotatably supported. The front end of the rotary shaft 12 projects out of the front housing 3 and receives power from an engine of the vehicle (not shown) or an external power source.

The compressor 1 further has a support 15 fixed on the rotary shaft 12 and a swash plate 16 mounted on the rotary shaft 12 so as to be slidable axially thereof. The swash plate 16 is provided with a guide pin 18 that is slidably fitted in a guide hole 17 formed in the support 15. The guide hole 17 and the guide pin 18 cooperate with each other to allow the swash plate 16 to be inclined relative to the axis of the rotary shaft 12 and also to be rotated together with the rotary shaft 12.

As the center of the swash plate 16 is moved toward the support 15, the inclination of the swash plate 16 increases. The maximum inclination of the swash plate 16 is defined by the contact of the swash plate 16 with the support 15. In FIG. 1, the maximum inclination of the swash plate 16 is indicated by phantom line, while the minimum inclination of the swash plate 16 is indicated by solid line. It is so arranged that the swash plate 16 at the minimum inclination is at an angle that is slightly greater than 0 degree.

The cylinder block 2 is formed with plural cylinder bores 19 (only one shown) in which pistons 20 (also only one shown) are received. The rotary motion of the swash plate 16 is transmitted through a pair of shoes 21 to the piston 20 so that the piston 20 reciprocates in the cylinder bore 19.

The rear housing 4 forms therein a suction chamber 22 and a discharge chamber 23. The suction chamber 22 communicates with the crank chamber 11 through a refrigerant bleed passage 24 having a flow restrictor of a fixed cross-sectional area. The bleed passage 24 extends through the cylinder block 2 and the valve plate assembly 5 at a position adjacent to the rotary shaft 12.

The valve plate assembly 5 has a refrigerant suction port 25 formed through the valve-port plate 8, the discharge-valve plate 9 and the retainer plate 10 and also has a refrigerant discharge port 26 formed through the valve-port plate 8 and the suction-port plate 7. The suction-port plate 7 is formed with suction valves (not shown), and the discharge-valve plate 9 is formed with discharge valves (not shown either). The retainer plate 10 is formed with retainers 27 (only one shown).

When the piston 20 is moving leftward in FIG. 1, refrigerant present in the suction chamber 22 is flowed through the suction port 25 into the cylinder bore 19 while pushing open the suction valve. Gaseous refrigerant in the cylinder bore 19 is compressed when the piston 20 is moving rightward in FIG. 1, and then discharged through the discharge port 26 into the discharge chamber 23 while pushing open the discharge valve. The discharge valve is brought into contact with the retainer 27 of the retainer plate 10 so that the opening of the discharge valve is limited.

The rear housing 4 is formed with a suction passage 28 through which refrigerant is introduced from an external refrigerant circuit (not shown) into the suction chamber 22, and also with a discharge passage 29 through which compressed refrigerant is discharged from the discharge chamber 23 into the external refrigerant circuit. The discharge passage 29 is provided with a check valve 30 which, when opened, allows the refrigerant in the discharge chamber 23 to flow into the external refrigerant circuit, and when closed, prevents the refrigerant in the discharge chamber 23 from flowing into the external refrigerant circuit.

Figure 2:
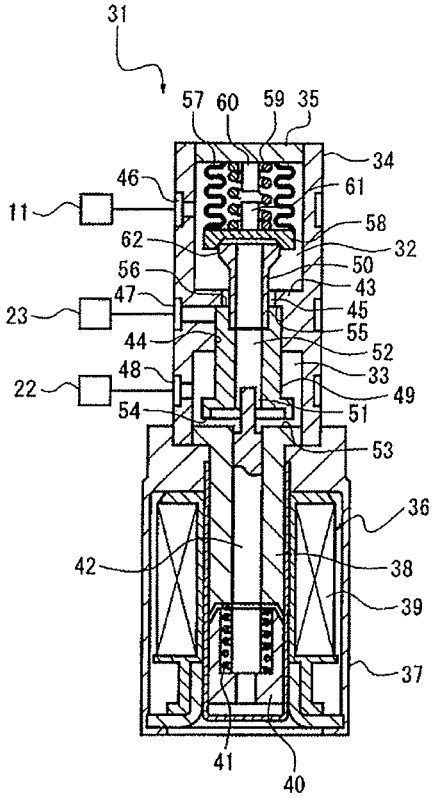
FIG. 2 is a longitudinal sectional view of a displacement control valve of the compressor of FIG. 1.

The compressor 1 further has an electromagnetic displacement control valve 31 mounted in the rear housing 4. Referring to FIG. 2, the displacement control valve 31 has a cylindrical valve housing 34 forming therein a second valve chamber 32 and a first valve chamber 33, a cover 35 closing one end of the valve housing 34, and a solenoid housing 37 integrated with the valve housing 34 and accommodating therein a solenoid 36. The solenoid 36 includes a stationary core 38, a movable core 40 and a coil 39. A spring 41 is interposed between the stationary core 38 and the movable core 40 and the movable core 40 is urged by the spring 41 to move away from the stationary core 38. The stationary core 38 attracts the movable core 40 when the coil 39 is energized. A rod 42 is secured to the movable core 40. The second valve chamber 32 corresponds to the valve chamber of the present invention.

The second valve chamber 32 and the first valve chamber 33 are separated by a partition wall 43 provided in the valve housing 34. The partition wall 43 is formed with a circular hole 44 communicating with the first valve chamber 33, and also formed with a hole 45 communicating with the second valve chamber 32 and having a smaller diameter than the hole 44. The valve housing 34 has three ports, namely a port 46 connecting the second valve chamber 32 to the crank chamber 11, a port 47 connected to the hole 44 and communicating with the discharge chamber 23, and a port 48 connecting the first valve chamber 33 to the suction chamber 22.

The rod 42 extends in the first valve chamber 33 and connected at one end thereof to a first cylindrical member 49 extending through the first valve chamber 33 and slidably fitted in the hole 44. The first cylindrical member 49 is connected at the end thereof opposite from the rod 42 to a second cylindrical member 50 extending through the hole 45 into the second valve chamber 32. The rod 42, the first cylindrical member 49 and the second cylindrical member 50 are moved together when the coil 39 is energized or deenergized. The end of the rod 42 connected to the first cylindrical member 49 is formed with a slit which serves as a passage 51 for connecting the first valve chamber 33 and an in-shaft passage 52 formed within the first and second cylindrical members 49, 50.

The first cylindrical member 49 has at the lower end thereof an annular third valve member 54 that is movable into contact with a valve seat 53 formed in the upper surface of the stationary core 38. Vertical movement of the rod 42 causes the third valve member 54 to move into contact with and away from the valve seat 53, so that the first valve chamber 33 is connected to and disconnected from the in-shaft passage 52. The first cylindrical member 49 has at the upper end thereof a first valve member 56 that is movable into contact with a valve seat 55 formed as a stepped portion between the holes 44, 45. Vertical movement of the rod 42 causes the first valve member 56 to move into contact with and away from the valve seat 55, so that the second valve chamber 32 is connected to and disconnected from the discharge chamber 23 through the port 47. The displacement control valve 31 controls the position of the first valve member 56 disposed in a refrigerant passage between the crank chamber 11 and the discharge chamber 23, thereby varying the displacement of the compressor 1.

There is provided in the second valve chamber 32 a bellows 57 connected at one end thereof to the cover 35, a pressure receiving disc 58 connected to the other end of the bellows 57, and a spring 59 disposed within the bellows 57 for urging the pressure receiving disc 58 to expand the bellows 57. The interior of the bellows 57 is under a vacuum, where two stoppers 60, 61 are disposed in facing relation to each other. The stopper 60 is fixed to the cover 35. The stopper 61 is fixed to the pressure receiving disc 58 and spaced from the stopper 60 at a predetermined distance. The stoppers 60, 61 define the contracted length of the bellows 57.

The upper end of the second cylindrical member 50 projecting into the second valve chamber 32 forms a second valve member 62 that has a relatively larger diameter and movable into contact with the lower surface of the pressure-receiving disc 58 as the valve seat. With the first valve member 56 in contact with the valve seat 55 and the third valve member 54 away from the valve seat 53, when the pressure in the in-shaft passage 52 exceeds the spring force of the spring 59, the pressure receiving disc 58 is lifted up from the second valve member 62, so that the second valve chamber 32 is connected to the first valve chamber 33.

As shown in FIG. 1, there is provided a drain passage 64 connecting the crank chamber 11 to the port 46 of the second valve chamber 32 of the displacement control valve 31 (see FIG. 2). The drain passage 64 serves as the bolt hole 63 that is located at the lowest of the plural bolt holes 63 and also at a position adjacent to the bottom of the compressor 1 when the compressor 1 is installed in place. Specifically, the drain passage 64 includes a first communication passage 78 and a second communication passage 65. The first communication passage 78 is formed at a position where the bolt hole 63 is formed, and has a larger diameter than the bolt hole 63. The first communication passage 78 is opened at its one end to the crank chamber 11 at the bottom thereof. The other end of the first communication passage 78 extends through the valve plate assembly 5 and into the rear housing 4.

The bolt 6 is inserted through the first communication passage 78 and screwed in the rear housing 4. The other end of the first communication passage 78 is connected to the second communication passage 65 that is formed in the rear housing 4 as a part of the drain passage 64. The second communication passage 65 is connected to the port 46 of the displacement control valve 31, so that the crank chamber 11 and the second valve chamber 32 are connected. The cross section of the drain passage 64 need not necessarily have a round shape as with the bolt hole 63, but may have an elliptical shape or polygonal shape such as a triangle. The cross sectional area of the drain passage 64 should preferably be as large as possible.

The discharge chamber 23 is connected to the port 47 of the displacement control valve 31 by a communication passage 66 formed in the rear housing 4. The suction chamber 22 is connected to the port 48 of the displacement control valve 31 by a communication passage 67 formed in the rear housing 4.

When the variable displacement compressor 1 is operated at its minimum displacement during the operation of the engine of the vehicle, the spring force of the spring 59 disposed in the bellows 57 causes the third valve member 54 to be in contact with the valve seat 53 and in its closed position and also the first valve member 56 to be away from the valve seat 55 and in its opened position. In this case, since the port 47 is connected to the second valve chamber 32, refrigerant in the discharge chamber 23 is supplied to the crank chamber 11, so that the inclination of the swash plate 16 is at the minimum. When the swash plate 16 is at the minimum inclination, the discharge pressure of refrigerant is low and the check valve 30 is closed, so that the circulation of refrigerant through the external refrigerant circuit is stopped and no cooling operation of the compressor 1 is performed.

When the compressor 1 is stopped, the spring force of the springs 41, 59 causes the rod 42 to be moved downward, so that the third valve member 54 is in its closed position and the first valve member 56 is in its opened position. When the compressor 1 is at a stop for a long period of time, refrigerant present in the compressor 1 is liquefied, and a large amount of liquid refrigerant, which is designated by symbol F, is stored in the crank chamber 11 and also in the second valve chamber 32 and the first valve chamber 33 of the displacement control valve 31. In this case, the bellows 57 is contracted against the spring force of the spring 59 by the hydraulic pressure in the second valve chamber 32, and a large amount of liquid refrigerant stored in the second valve chamber 32 is flowed through the in-shaft passage 52 and the passage 51 into the suction chamber 22 and stored therein.

Figure 3:
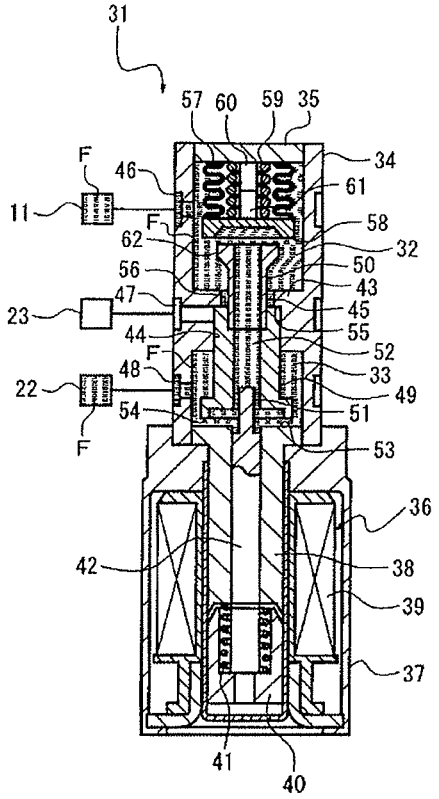
FIG. 3 is similar to FIG. 2, but explaining the operation of the displacement control valve just after a start of the compressor.

When the cooling operation of the compressor 1 is started with a large amount of liquid refrigerant stored in the crank chamber 11, as shown in FIG. 3, the coil 39 is energized, so that the movable core 40 is attracted toward the stationary core 38 and the rod 42 is moved vertically, with the result that the third valve member 54 is placed in its opened position and the first valve member 56 in its closed position. The liquid refrigerant F filling the first valve member chamber 33 of the displacement control valve 31 is flowed through the third valve member 54 and the passage 51 into the in-shaft passage 52. The pressure of the liquid refrigerant F filling the in-shaft passage 52 causes the pressure receiving disc 58 to be lifted up against the spring force of the spring 59, so that the second valve member 62 becomes opened.

Figure 4:
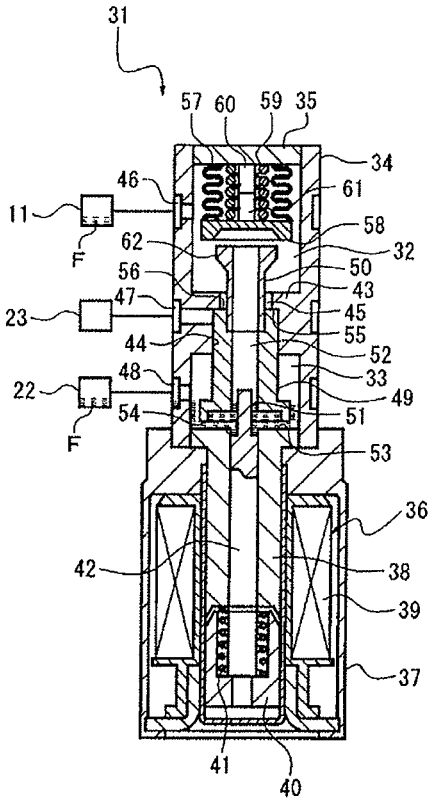
FIG. 4 is similar to FIG. 2, but explaining the operation of the displacement control valve after the start of the compressor.

As the operation of the compressor 1 is continued, liquid refrigerant in the displacement control valve 31 is drained through the second valve member chamber 32, the in-shaft passage 52, the first valve member chamber 33, the port 48 and the communication passage 67 into the suction chamber 22, as shown in FIG. 4. Simultaneously, liquid refrigerant in the crank chamber 11 is drained through the first and the second communication passages 78, 65 of the drain passage 64, the port 46, the second valve member chamber 32, the in-shaft passage 52, the first valve member chamber 33, the port 48 and the communication passage 67 into the suction chamber 22 smoothly.

In the present embodiment, the drain passage 64 opened to the crank chamber 11 serves as the bolt hole 63 that is located at a position adjacent to the bottom of the compressor 1, which allows the liquid refrigerant present in the bottom of the crank chamber 11 to be drained quickly. Since the time taken to drain the liquid refrigerant completely from the start of the operation of the compressor 1 is shortened, the pressure in the crank chamber 11 is quickly lowered and, therefore, the inclination of the swash plate 16 is shifted quickly from minimum to maximum, with the result that the desired cooling performance is obtained quickly after a start of the compressor 1.

During the cooling operation after the start of the compressor 1, the pressure of the suction chamber 22 is not increased to a level that is high enough to open the second valve member 62, and the crank chamber 11 is prevented from connecting to the suction chamber 22 through the displacement control valve 31. Thus, in the compressor 1 having the drain passage 64 located at a position adjacent to the bottom of the crank chamber 11, lubricating oil in the bottom of the crank chamber 11 is prevented from flowing out therefrom through the drain passage 64.

Figure 5:
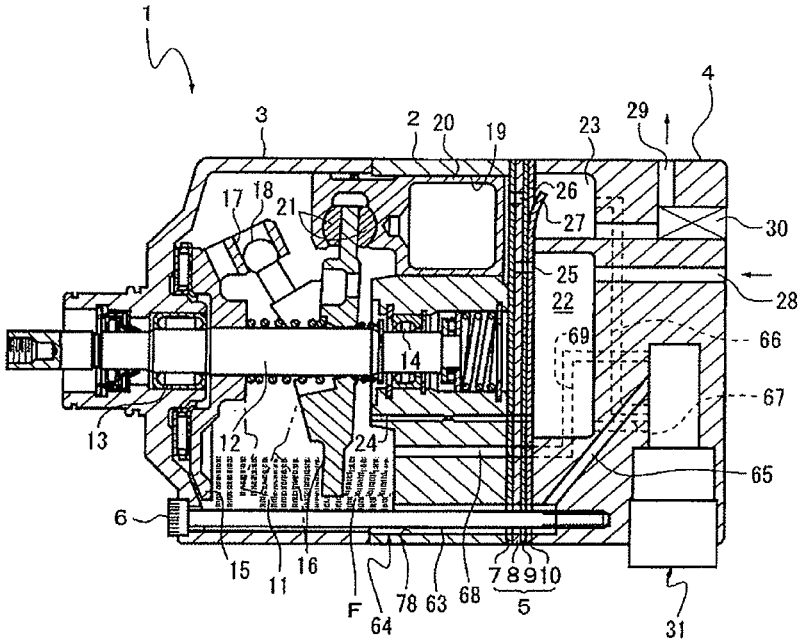
FIG. 5 is a longitudinal sectional view of a second embodiment of the variable displacement compressor according to the present invention.

FIG. 5 shows the second embodiment of the variable displacement compressor according to the present invention. In the drawing, same reference numerals are used for the common elements or components in the first and the second embodiments, and the description of such elements or components of the second embodiment will be omitted. The second embodiment differs from the first embodiment in that an additional drain passage 68 extending parallel to the drain passage 64 of the first embodiment is provided. The drain passage 68 is formed in the cylinder block 2 at a position above the drain passage 64 that is located at a position adjacent to the bottom of the variable displacement compressor 1 when the compressor 1 is installed in place. The drain passage 68 is opened at one end thereof to the crank chamber 11. The other end of the drain passage 68 extends through the valve plate assembly 5 and connected to the port 46 of the displacement control valve 31 through a communication passage 69 formed in the rear housing 4.

In the second embodiment, when the compressor 1 is started after a long stop, a large amount of liquid refrigerant F stored in the crank chamber 11 is drained through both of the drain passages 64, 68 toward the suction chamber 22, which shortens the time taken to drain the liquid refrigerant F. When the level of the liquid refrigerant F is lowered to the opening of the drain passage 68 in the crank chamber 11, the remaining liquid refrigerant F is drained through the drain passage 64 toward the suction chamber 22 quickly.

Figure 6:
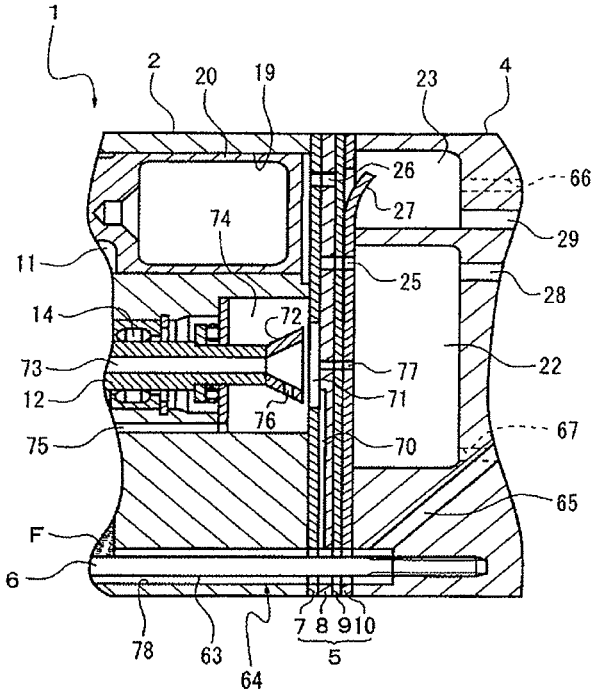
FIG. 6 is a fragmentary sectional view of a third embodiment of the variable displacement compressor according to the present invention, showing a valve plate assembly and its related components of the compressor.
Figure 7:
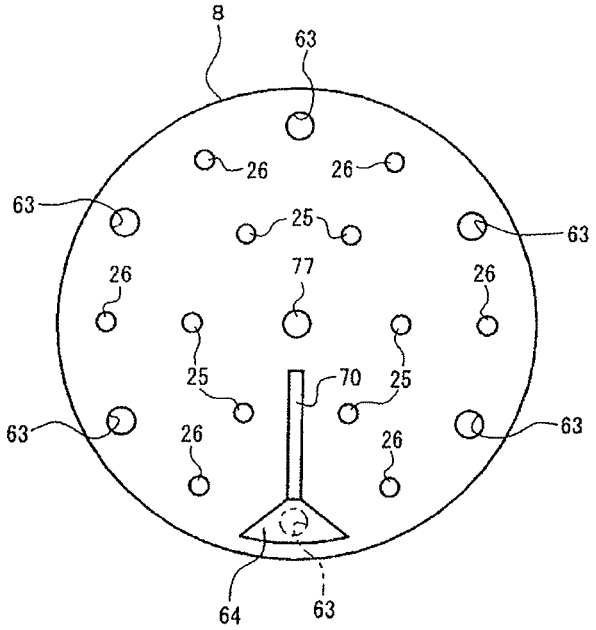
FIG. 7 is a plan view of a valve port plate of the valve plate assembly of FIG. 6.

FIGS. 6 and 7 show the third embodiment of the variable displacement compressor according to the present invention. In the drawings, same reference numerals are used for the common elements or components in the first and the third embodiments, and the description of such elements or components of the third embodiment will be omitted. The third embodiment differs from the first embodiment in that a drain groove 70 extending from the drain passage 64 of the first embodiment is provided. The drain groove 70 is provided by a radially extending groove formed in the front surface of the valve-port plate 8, as shown in FIG. 7. The drain groove 70 is connected at one end thereof to the drain passage 64. The drain groove 70 extends radially toward the center of the valve-port plate 8 and is connected at the other end thereof to a hole 71 formed in the center of the suction-valve plate 7 having a relatively larger diameter (see FIG. 6). In the valve plate assembly 5 in which the valve-port plate 8 and the suction-valve plate 7 are laminated together, the rear surface of the suction-valve plate 7 and the drain groove 70 cooperate to form therebetween a passage that connects the drain passage 64 and the hole 71 of the suction-valve plate 7.

As shown in FIG. 6, the rotary shaft 12 has therein a third communication passage 73 and is formed at the rear end thereof with a flared portion 72 having a flared opening that faces the hole 71 of the suction-valve plate 7. One end of the third communication passage 73 is connected to the crank chamber 11. The space around the rear end of the rotary shaft 12 forms a drain chamber 74. The drain chamber 74 is connected to the crank chamber 11 through a communication passage 75 so that the drain chamber 74 and the crank chamber 11 are substantially at the same pressure. The drain chamber 74 is connected through the hole 71 to the drain groove 70 and also connected through a communication passage 76 to the third communication passage 73 formed in the rotary shaft 12. The valve plate assembly 5 has a fourth communication passage 77 formed through the valve-port plate 8, the discharge-valve plate 9 and the retainer plate 10 at the center thereof for connecting the drain chamber 74 and the suction chamber 22 through the hole 71. The fourth communication passage 77 has a smaller diameter than the third communication passage 73, serving as a flow restrictor of a fixed cross-sectional area. In the third embodiment, the third communication passage 73, the drain chamber 74 and the fourth communication passage 77 cooperate to form a bleed passage that connects the crank chamber 11 and the suction chamber 22.

In the third embodiment, when the compressor 1 is started after a long stop, a large amount of liquid refrigerant F stored in the crank chamber 11 is drained through the first and second communication passages 78, 65 of the drain passage 64 into the second valve chamber 32 of the displacement control valve 31. Since the drain passage 64 is connected to the drain groove 70, some of the liquid refrigerant F flowing in the drain passage 64 is flowed from the drain passage 64 into the drain groove 70. Part of the liquid refrigerant F flowing in the drain groove 70 is flowed through the hole 71 and the fourth communication passage 77 and drained directly into the suction chamber 22. The rest of the liquid refrigerant F flowing in the drain groove 70 is passed through the hole 71 and flowed into the drain chamber 74 of the bleed passage. The liquid refrigerant F in the drain chamber 74 is flowed through the communication passage 76 into the third communication passage 73 and then drained directly into the suction chamber 22 through the hole 71 and the fourth communication passage 77. Thus, the liquid refrigerant F stored in the crank chamber 11 is drained into the suction chamber 22 through two different flow paths, namely, the displacement control valve 31 and the drain groove 70, which further helps to shorten the time taken to drain the liquid refrigerant completely, so that the desired cooling performance of the compressor 1 is obtained quickly.

It is to be understood that the present invention is not limited to the above-described embodiments, but it may be modified in various ways as exemplified below without departing from the scope of the invention.

(1) Although in the first to third embodiments the bolt 6 inserted through the drain passage 64 is intended to be located at the lowest position in the compressor 1 when the compressor 1 is installed in place on a vehicle, the bolt such as 6 need not necessarily be located at the lowest position in the compressor. The bolt hole such as 63 located closest to the lowest position in the compressor may be used as the drain passage such as 64.

(2) The displacement control valve need not necessarily have a structure as described above, but may have various structures, for example, the structure as disclosed in Japanese Unexamined Patent Application Publications No. 2005-307817 and No. 2006-118462.

What is claimed is:

1. A variable displacement compressor, comprising:

a swash plate the inclination of which is variable;

a housing having therein a crank chamber in which the swash plate is disposed, a discharge chamber, a suction chamber and a cylinder bore, the housing having plural bolt holes and being formed by separate members that are fastened together by plural bolts inserted through the plural bolt holes;

a displacement control valve having a first valve member movable to connect the crank chamber and the discharge chamber, the displacement control valve controlling the position of the first valve member to vary the displacement of the compressor, the displacement control valve having a valve chamber and a second valve member that serves to connect the crank chamber and the suction chamber in the valve chamber, the valve chamber being connected to the crank chamber by a drain passage, wherein part of the drain passage serves as the bolt hole located at the lowest of the plural bolt holes when the compressor is installed, the bolt hole connecting the crank chamber and the suction chamber, and allowing liquid refrigerant in the crank chamber to flow out to the suction chamber via the bolt hole; and a bleed passage constantly connecting the crank chamber and the suction chamber, the bleed passage located at an upper position of the drain passage on the compressor;

the second valve member closes the drain passage when an inclination of the swash plate is increasing;

and the swash plate and the bolt inserted in the lowest bolt hole are separated from each other, wherein the housing includes a rear housing forming therein the discharge chamber and the suction chamber, wherein the drain passage includes a first communication passage opened to the crank chamber and extending to the rear housing and a second communication passage formed in the rear housing and connecting the first communication passage to the valve chamber, wherein the variable displacement compressor further includes a valve plate assembly disposed between the cylinder bore and the rear housing, and a rotary shaft rotating together with the swash plate, wherein the rotary shaft has therein a third communication passage, the third communication passage is connected to a drain chamber that is formed around an end of the rotary shaft and is connected to the crank chamber, the drain chamber is connected to the suction chamber by a fourth communication passage formed in the valve plate assembly, the third communication passage cooperates with the drain chamber and the fourth communication passage to form the bleed passage that connects the crank chamber and the suction chamber, wherein the valve plate assembly includes a valve-port plate and a suction-valve plate laminated together, the valve-port plate is formed with a drain groove connected to the drain passage and the drain chamber, the drain groove of the valve-port plate and the suction-valve plate cooperate to form therebetween a passage, wherein part of a liquid refrigerant flowing in the drain passage is drained into the suction chamber through the drain groove and the bleed passage.

2. The variable displacement compressor of claim 1, wherein the crank chamber and the valve chamber are connected by an additional drain passage that is disposed above the drain passage when the compressor is installed.

* * * * *